United States Patent [19]

Sasaki

[11] Patent Number: 4,569,385

[45] Date of Patent: Feb. 11, 1986

[54] SYSTEM FOR THE PREPARATION OF CERAMIC SHELL MOLDS

[75] Inventor: Nobuyoshi Sasaki, Yokohama, Japan

[73] Assignee: M.C.L. Co., Ltd., Kanagawa, Japan

[21] Appl. No.: 554,203

[22] Filed: Nov. 22, 1983

[30] Foreign Application Priority Data

Nov. 26, 1982 [JP] Japan ..... 57-207312

[51] Int. Cl.[4] ..... B22C 13/08

[52] U.S. Cl. ..... 164/166; 164/516

[58] Field of Search ..... 164/166, 328, 516

[56] References Cited

U.S. PATENT DOCUMENTS

| | | | |
|---|---|---|---|
| 1,561,780 | 11/1925 | Engel | 164/328 X |
| 2,278,815 | 4/1942 | Winkel | 164/328 X |
| 3,278,998 | 10/1966 | Tingquist et al. | 164/166 |
| 3,602,288 | 8/1971 | Trench et al. | 164/166 |
| 3,796,251 | 3/1974 | Jasson et al. | 164/166 |

FOREIGN PATENT DOCUMENTS

| | | | |
|---|---|---|---|
| 662245 | 5/1979 | U.S.S.R. | 164/166 |

*Primary Examiner*—Nicholas P. Godici
*Assistant Examiner*—J. Reed Batten, Jr.
*Attorney, Agent, or Firm*—Laff, Whitesel, Conte & Saret

[57] ABSTRACT

An improved system for the preparation of ceramic shell molds comprises a rotary disk which is mounted for rotating in a substantially horizontal plane. A plurality of wax master mounting bars are pivotally carried by the rotary disk to move around the periphery of the rotary disk. The mounting bars have free ends loaded with the wax masters. The rotary disk is operatively associated with the wax master mounting bars for swinging and rotating the bars on their own axes as the rotary disk rotates continuously. The preferred embodiment comprises a cam of generally twisted undulating cam strips and a roller attached to the base ends of the bars for frictionally engaging the cam face of the cam strip to swing the bars and to rotate them on their own axes. A slurry bath, a drain bath, and a stucco bath are arranged around the exerior side of the periphery of the rotary disk.

9 Claims, 3 Drawing Figures

II
II
30g
48
32
34
34
32
30f
30h
40
36
42
28
30a
12
30e
18
52
30b
14
36
46
52
30c
44

SYSTEM FOR THE PREPARATION OF CERAMIC SHELL MOLDS

BACKGROUND OF THE INVENTION

1. Field of the Invention

The present invention relates to a system for the preparation of ceramic shell molds by coating wax masters with fine particles of refractory material to obtain ceramic shell molds for use in the investment casting process.

In the investment or lost-wax casting process, each wax mold is firstly dipped into a slurry containing a binder and a filler, the excess slurry being drained off from the wax master, and then the wax master wetted by the slurry is coated with a so-called stucco powder made of fine particles of refractory material followed by drying to form a coating layer of refractory material. The aforementioned step for the formation of coating layer is repeated until a coating layer having a desired thickness is formed. The thickness of the coating layer requisite for the ceramic shell molding process is different from that for the solid molding process. However, irrespective of whether the coating layer is formed for the ceramic shell mold or for the solid mold, the coating steps must be repeated for several times. Accordingly, improvement in efficiency of this coating step would provide great contribution to the improvement in producibility of overall casting process and also to the reduction in production cost.

2. Prior Art

One example of previously proposed automation systems for the preparation of ceramic shell molds comprises a conveyer, a slurry bath and a stucco powder bath sequentially disposed in this order along the conveyer, and an industrial robot. However, this known automation system has a disadvantage that it is inevitable to use the robot devotedly for holding each wax master for a considerable time to effect drainage of the excess slurry after the wax master is pulled out of the slurry bath. This results in down-time during which the operation of overall system must be stopped. For this reason, the production efficiency of this known automation system is not increased to a satisfactory level.

SUMMARY OF THE INVENTION

Accordingly, a principal object of this invention is to provide a system for preparing ceramic shell molds automatically and continuously at high production efficiency.

Another object of this invention is to provide such a system united in a compact form.

The ultimate object of this invention is to improve the efficiency in the step of forming a ceramic shell mold significantly thereby to decrease the total cost for the precision casting processes by the provision of an automation system for preparing ceramic shell molds continuously and efficiently.

In order to attain the aforementioned objects, the present invention provides a system for the preparation of ceramic shell molds, comprising: a rotary disk for rotating in a substantially horizontal plane; a plurality of wax master mounting bars pivotally carried by said rotary disk to be moved around the periphery of said rotary disk by the rotational movement of said rotary disk and having free ends for carrying thereon wax masters; cam means operatively associated with said rotary disk for swinging said wax master mounting bars from the upright position to the positions where said wax master mounting bars extend in inclined downward direction; cam follower means attached to the base ends of said wax master mounting bars to be guided by said cam means to swing said wax master mounting bars and including means for rotating said was master mounting bars on their own axes as they move around the periphery of said rotary disk; a slurry bath disposed around the exterior side of the periphery of said rotary disk for receiving therein the wax masters mounted on said free ends of said wax master mounting bars which pass beyond the slurry bath while extending in said inclined downward direction; a drain bath disposed around the exterior of the periphery of said rotary disk at a position downstream of said slurry bath for receiving excess slurry falling from the wax master mounted on said free ends of said wax master mounting bars which pass beyond the drain bath while being held in a raised position; and a stucco powder bath disposed around the exterior side of the periphery of said rotary disk at a position downstream of said drain bath for receiving therein the wax masters mounted on said free ends of said wax master mounting bars which pass beyond the stucco particle bath while extending in said inclined downward direction.

DESCRIPTION OF THE APPENDED DRAWINGS

The above and other objects of the invention and advantages obtainable thereby will become apparent from the following description with reference to the appended drawings, wherein.

DESCRIPTION OF A PREFERRED EMBODIMENT

Figure 1:
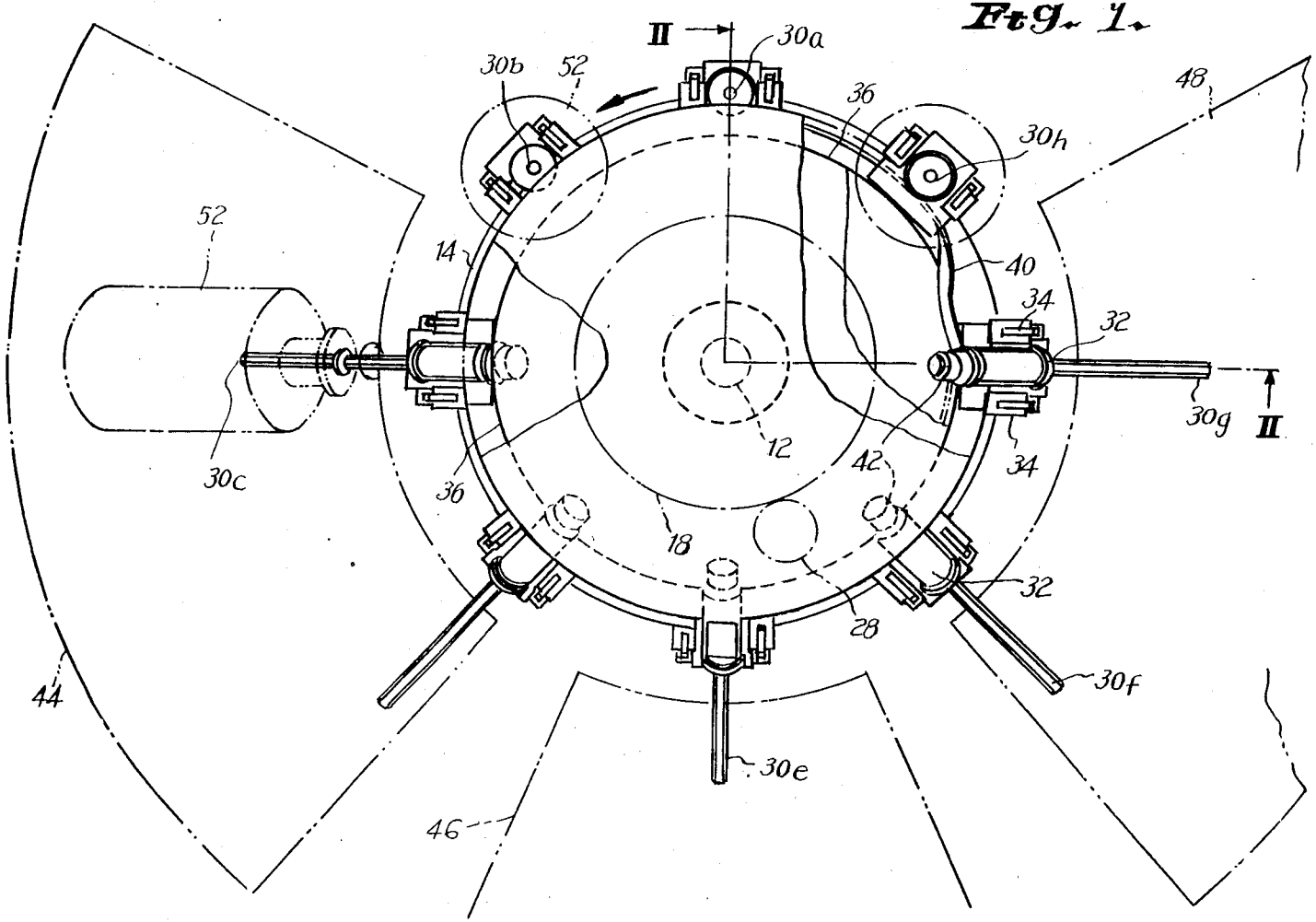
FIG. 1 is a schematic illustration showing a plan view, partly in section, of one embodiment of the system according to the invention.

A presently preferred embodiment of the invention will now be described with reference to the appended drawings in which a base is denoted by 10 and carries a support shaft 12 fixed thereon and extending in a substantially vertical direction. A rotary disk 14 provided with a circular bore (not shown) at the center thereof is rotatably carried by a bearing 16 mounted around the support shaft 12 with the upper portion of the support shaft 12 protruding through the central bore of the rotary disk 14. A large sun gear 18 is fixedly mounted on the downside surface of the rotary disk 14. An electromotor 20 is mounted on the base 10 and provided with speed change means 22 which may be operated manually to change the rotational speed of the electromotor 20 continuously. The output of the electromotor 20 is transmitted to a worm reduction gear 24 through a power transmission belt 26. A pinion 28 is mounted on the output shaft of the reduction gear 24 to mesh with the sun gear 18.

Upon energization of the electromotor 20, the rotation torque is transmitted through the power transmission belt 26, the worm reduction gear 24, the pinion 28 and the sun gear 18 to the rotary disk 14, whereby the rotary disk 14 is rotated in the counter-clockwise direction as viewed in FIG. 1.

A plurality of, eight in the illustrated embodiment, wax master mounting bars 30 (30*a* to 30*h*) each having a hexagonal cross-section extend from the periphery of the rotary disk 14 in the radial directions. The base end of each wax master mounting bar 30 is rotatably carried by a corresponding bearing 32 having a cylindrical housing which is pivotally supported by stays 34 upstanding from the upside surface of the rotary disk 14. With this construction, each of the wax master mounting bars 30 is allowed to be swinged or pivoted in the planes containing the rotation axis of the rotary disk 14, and also to be rotated about its own axis.

A generally annular plate 36 is fixed to the support shaft 12 at a vicinity of the upper end of the support shaft 12, and a plurality of brackets 38 extends downwards from the peripheral edge portions of the plate 36 to firmly support a cam strip 40. The cam strip 40 has a general contour of twisted undulating annular shape with a portion broken away. As seen from FIGS. 1 and 2, each wax master mounting bar 30 has a free end extending upwards at the upright position shown by 30*a*, and the other or base end of each bar 30 protrudes through the housing of the bearing 32 to extend downwards at the upright position shown by 30*a*. As rubber roller 42 is attached to the base end of each wax master mounting bar 30 to be engaged with and rotated by the aforementioned cam strip 40. As should be easily understood by a person having ordinary skill in the art, in addition to the rolling movement by the engagement with the cam strip 40, the rubber roller 42 acts as cam follower means to follow the smoothly twisted and undulating cam face of the cam strip 40 so that each wax master mounting bar 30 is rotated about its own axis and concurrently forced to swing from the upright position shown by 30*a* to the position where it extends in the inclined downward direction as shown by 30*c*, to the position held in a raised posture shown by 30*e*, and again to the position where it extends in the inclined downward direction as shown by 30*g*, as the rubber roller 42 rolls along the cam strip 40. As will be clearly understood from the foregoing description, means for swinging the wax master mounting bars 30 and for rotating them on their own axes are provided by the combination of the twisted undulating cam strip 40 and the rubber roller 42. It should be noted here that the cam follower means is not limited only to the rubber roller, but any other means frictionally engaging with the cam strip 40 to be rotated thereby may be used, examples being liners or coatings of synthetic resins applied on the peripheral face of the base end of the bars 30. Otherwise, the cam face of the cam strip 40 may be coated with a rubber or synthetic resin having high friction factor.

In FIG. 1, areas 44, 46 and 48 enclosed by dots-and-dash lines designate a slurry bath, a drain bath and a stucco powder bath arranged in this order around the exterior side of the periphery of the rotary disk 14. The slurry bath 44 contains a slurry containing a binder and a filler dispersed in a liquid and agitated continuously by a pump. The drain bath 46 is a receiver for receiving slurry droplets falling from the wax masters after they are raised from the slurry bath 44. A so-called stucco powder composed of particles of refractory material is contained in the stucco powder bath 48. As seen from FIG. 2, a porous ceramic plate 50 extends across the lower portion in the stucco powder bath 48 to allow passage of turbulent air so that the particles of refractory material contained in the bath 48 are suspended by the turbulent air flow supplied through the plate 50.

The operation of the illustrated embodiment will now be described. The rotary disk 14 is rotated by actuating the electromotor 20. A wax master mounting rod 30*a* having the free end which is not yet loaded with a wax master 52 extends upright by the action of the weight of the base end thereof attached with the bearing 32 and the rubber roller 42 so that the rubber roller 42 is disengaged from the cam strip 40. Upon loading a wax master 52 to the free end, the upper end as viewed in FIG. 1, of the bar 30 becomes in an unstable condition with its free end becoming heavier than the base end. When the bar 30 is rotated by about 45° to the position denoted by 30*b*, a further cam plate (not shown) depending from the annular plate 36 abuts against the rubber roller 42 to swing the bar and the wax master 52 loaded thereon radially outwards to incline the bar 30. Whereupon, the rubber roller 42 engages with the cam strip 40 while being pressed frictionally by the action of the weight of the wax master 52 so that the bar 30 is rotated about its own axis as the rubber roller 42 moves along the cam strip 40. After passing through the position 30*b*, the rubber roller 42 is guided smoothly and gradually by the twisted cam strip 40 to swing the free end of the bar 30 downwards to the inclined downward position denoted by 30*c* so that the wax master 52 enters into the slurry bath 44 while being slanting gradually and rotated about the axis of the bar 30. Since the wax master 52 is rotated continuously about the axis of the bar 30, it can be coated with the slurry uniformly without the fear of damage. The rotary disk 14 continues to rotate by 135° to bring the wax master 52 to the position denoted by 30*d* at which the wax master 52 is raised by swinging the bar 30 so that the excess slurry falls from the outer surface of the rotating wax master 52 to the drain bath 46 disposed in the neighbourhood of the position denoted by 30*e*.

The rotary disk 14 is further rotated to bring the wax master 52 to the position denoted by 30*f* at which the wax master 52 is lowered again to enter into the stucco powder bath 48 while being rotated about the axis of the bar 30 and passing through a smoothly slanting passageway. The wetted wax master 52 is coated with stucco particles of refractory material suspended by turbulent air as it passes through the bath 48, while being held in the lowermost position as best seen by 30*g* in FIG. 2. Thereafter, the bar 30 is swung upwards until it takes the upright posture at the position denoted by 30*h* at which the rubber roller 42 disengages from the cam strip 40 so that the rotation about the axis of the bar 30 is stopped to enable easy dismounting of the finished product at any desired position from the position 30*h* to the position 30*a*. The finished product dismounted from the wax master mounting bar 30 is then conveyed by a conveyer (not shown) to a drying chamber.

Figure 2:
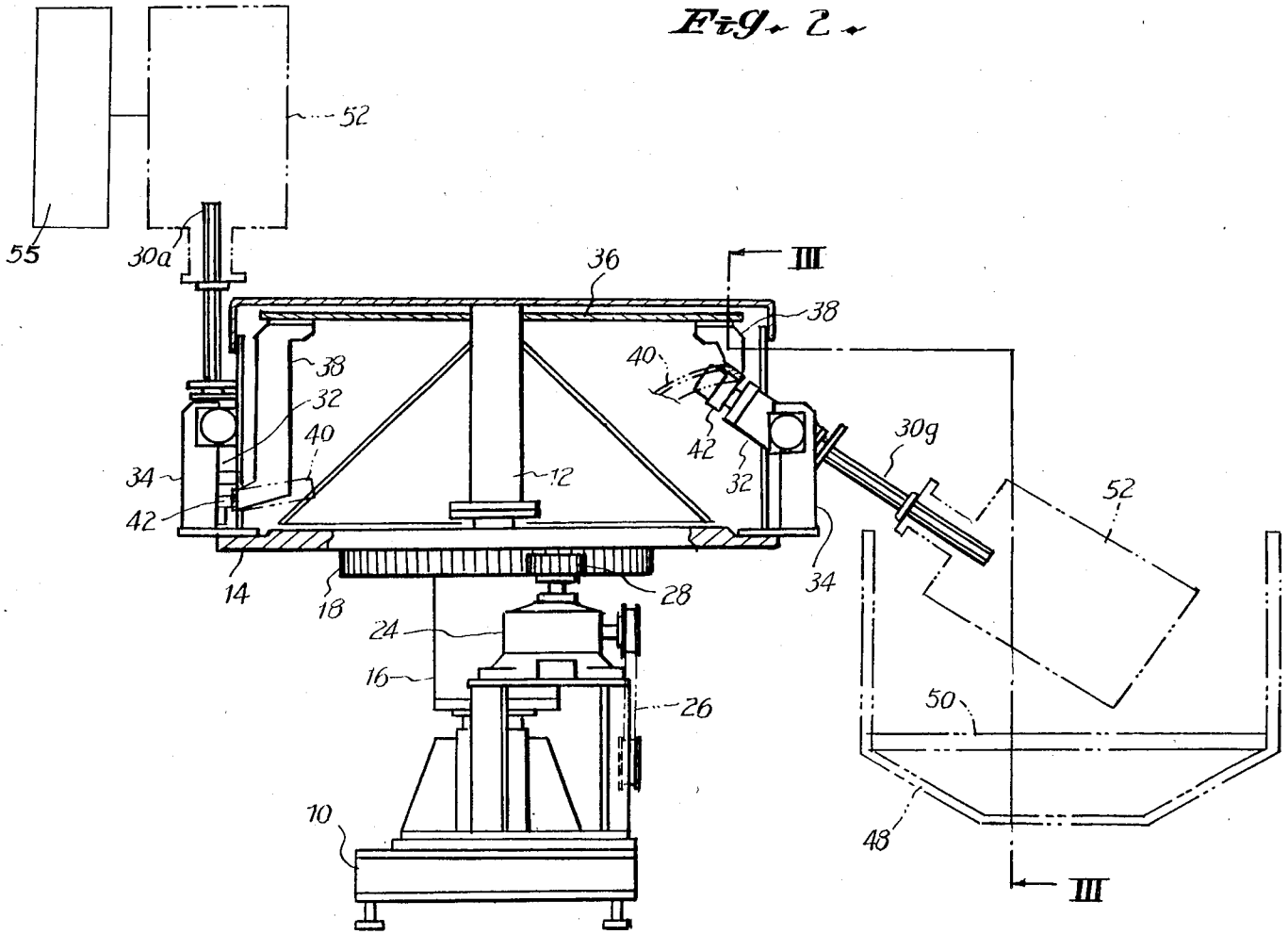
FIG. 2 is a cross section taken along line II—II of FIG. 1.
Figure 3:
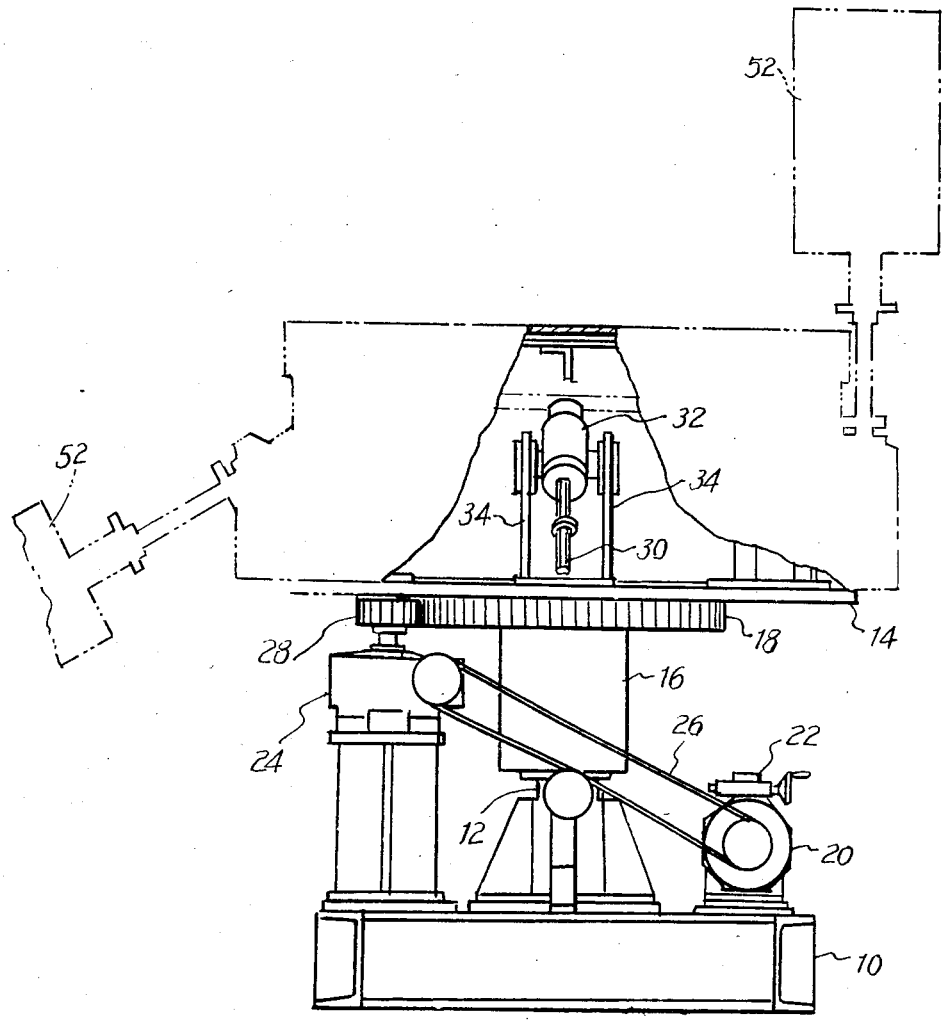
FIG. 3 is a schematic illustration as viewed along line III—III of FIG. 2.

According to the present invention, the wax masters 52 may be coated with particles of refractory material automatically and continuously until a coating layer of desired thickness is formed over each wax master at high production efficiency. As shown in FIG. 2, an industrial robot, as represented by reference character 55, may be combined with the system of the invention to mount and dismount the wax masters on and from the wax master mounting bars 30 to provide a full automation system. The production efficiency of the full automation system made by combining the system of the invention with an industrial robot is increased as approximately three times as high as that of the combination of an industrial robot with the conventional system including a conveyer and slurry and stucco powder baths disposed adjacent to the conveyer.

The construction of the system is simplified by the combination of the twisted undulating cam strip 40 and the rubber roller 42 mounted on the base end of each wax master mounting bar 30 and frictionally engaging with the cam face of the cam strip 40 to be forced to roll as it moves along the cam face, according to the embodiment described above. However, means for swinging the wax master mounting bars 30 and for rotating them on their own axes may be assembled by the combination of other appropriate means, such as gearing or link mechanisms.

As has been described hereinbefore, according to the present invention, a plurality of wax master mounting bars is mounted on the periphery of a rotary disk which is rotated continuously, and means are provided for swinging the bars from the upright position to the positions where the bars extend in inclined downward direction, the bars being raised to a raised position to pass beyond the partition walls of the baths, and for continuously rotating the bars about their own axes. Accordingly, the wax masters mounted on the free ends of the wax master mounting bars are dipped automatically in the processing baths disposed around the exterior side of the periphery of the rotary disk one by one for repeated operation cycles until coatings of desired thickness are formed thereon. By the use of the system of the invention, the production efficiency can be increased remarkedly to reduce the production cost significantly.

Although the present invention has been described with reference to a preferred embodiment thereof, many changes and modifications may be made without departing from the spirit and scope of the invention. It is thus intended to embrace such changes and modifications within the extension of the invention as defined by the appended claims.

What is claimed is:

1. A system for the preparation of ceramic shell molds, said system comprising:

a rotary disk mounted for rotation in a substantially horizontal plane;

a plurality of wax master mounting bars pivotally carried by said rotary disk to be moved around the periphery of said rotary disk responsive to the rotational movement of said rotary disk, said mounting bars having free ends for carrying wax masters thereon;

cam means operatively associated with said rotary disk for swinging said wax master mounting bars between an upright position and a downwardly inclined position;

cam follower means attached to base ends of said wax master mounting bars and guided by said cam means to swing said wax master mounting bars, said cam follower means including means for rotating said wax master mounting bars on their own axes as they move around the periphery of said rotary disk;

a slurry bath disposed around the exterior side of the periphery of said rotary disk for receiving therein the wax masters mounted on said free ends of said wax master mounting bars which pass beyond the slurry bath while extending in said inclined downward direction;

a drain bath disposed around the exterior of the periphery of said rotary disk at a position downstream of said slurry bath for receiving excess slurry falling from the wax master mounted on said free ends of said wax master mounting bars which pass beyond the drain bath while being held in a raised position; and a stucco bath disposed around the exterior side of the periphery of said rotary disk at a position downstream of said drain bath for receiving therein the wax masters mounted on said free ends of said wax master mounting bars which pass beyond the stucco bath while extending in said inclined downward direction.

2. The system according to claim 1, wherein the base end portions of said wax master mounting bars are rotatably carried by bearing means.

3. The system according to claim 1, wherein the weight of said cam follower means are heavy enough for spontaneously swinging said wax mounting bars to the upright position to be disengaged from said cam means when said wax masters are dismounted from said wax master mounting bars.

4. The system according to claim 1, further comprising loading and unloading means for loading said wax masters on said wax master mounting bars and for unloading said wax masters from said wax master mounting bars after a shell coating layer of desired thickness is formed.

5. The system according to claim 4, wherein said loading and unloading means is an industrial robot.

6. The system according to claim 1, wherein said cam means is a cam strip which is twisted and undulated to provide a continuous cam face.

7. The system according to claim 6, wherein said cam strip is a generally annular strip with a portion broken away.

8. The system according to claim 1, 6 or 7, wherein said cam follower means is a roller for engaging frictionally with said cam means.

9. The system according to claim 8, wherein said roller is made of a rubber.

* * * * *